US008169159B2

(12) United States Patent
Lu et al.

(10) Patent No.: US 8,169,159 B2
(45) Date of Patent: May 1, 2012

(54) BOOST CONVERTER LED DRIVER AND CONTROLLER THEREOF

(75) Inventors: Chien-Ping Lu, Tainan (TW); Wei-Hsin Wei, Jhubei (TW); Kwan-Jen Chu, Hsinchu (TW); Tzu-Huan Chiu, Jhubei (TW)

(73) Assignee: Richtek Technology Corp., Hsinchu (TW)

( * ) Notice: Subject to any disclaimer, the term of this patent is extended or adjusted under 35 U.S.C. 154(b) by 711 days.

(21) Appl. No.: 12/232,696

(22) Filed: Sep. 23, 2008

(65) Prior Publication Data

US 2010/0019682 A1 Jan. 28, 2010

(30) Foreign Application Priority Data

Jul. 25, 2008 (TW) ..... 97128463 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/307; 315/209 R; 315/291

(58) Field of Classification Search ..... None
See application file for complete search history.

(56) References Cited

U.S. PATENT DOCUMENTS

| | | | | |
|---|---|---|---|---|
| 6,864,641 | B2 * | 3/2005 | Dygert | 315/216 |
| 7,439,945 | B1 * | 10/2008 | Awalt et al. | 345/83 |
| 7,919,928 | B2 * | 4/2011 | Ziegenfuss | 315/227 R |
| 2005/0243022 | A1 * | 11/2005 | Negru | 345/46 |
| 2007/0091036 | A1 * | 4/2007 | Han et al. | 345/82 |

OTHER PUBLICATIONS

Pistoia, Gianfranco, Battery Operated Devices and Systems: From Portable Electronics to Industrial Products [online] , 2008, First Edition, Elsevier, p. 133 [retrieved on Mar. 22, 2011]. Retrieved from the Internet:<URL:http://books.google.com/books?id=117GF5bJH3UC&pg=PA133&dq=asynchronous+boost+converter&hl=en&ei=tgpwTa_HNpHpgQfUONxQ&sa=X&oi=book_r>.*

* cited by examiner

*Primary Examiner* — Douglas W Owens
*Assistant Examiner* — Dedei K Hammond
(74) *Attorney, Agent, or Firm* — Rosenberg, Klein & Lee

(57) ABSTRACT

A LED driver is disclosed for providing a current for LED lighting. The LED driver includes an inductor and a controller having a power switch, and the inductor, the power switch and a LED to be driven are configured to be an asynchronous boost converter. Because the driven LED serves as a rectifier diode of the asynchronous boost converter, the controller may have fewer components and requires smaller die area.

2 Claims, 3 Drawing Sheets

BOOST CONVERTER LED DRIVER AND CONTROLLER THEREOF

FIELD OF THE INVENTION

The present invention is related generally to a light-emitting diode (LED) driver and, more particularly, to a controller of a LED driver.

BACKGROUND OF THE INVENTION

FIG. 1 shows a conventional LED driver 10 configured with a boost converter for LED Lighting, which includes a controller 11, an inductor L and an output capacitor Cout. The controller 11 is a semiconductor chip, the inductor L is coupled between a power supply VIN and a phase pin LX of the controller 11, and the output capacitor Cout is coupled to an output pin OUT of the controller 11. In the controller 11, an n-type metal-oxide-semiconductor (NMOS) transistor 22 serving as a power switch is coupled between the phase pin LX and a ground node GND, and a p-type metal-oxide-semiconductor (PMOS) transistor 24 serving as a power switch is coupled between the phase pin LX and the output pin OUT. The inductor L, the NMOS transistor 22 and the PMOS transistor 24 are so configured to be a boost converter, and a logic circuit 20 provides control signals S4 and S5 to switch the power switches 22 and 24 to produce an output voltage which is higher than the turn-on voltage VF of a LED 28 for lighting the LED 28. A current sensor 18 monitors the inductor current IL to produce a current sense signal S1, a slope compensator 12 compensates the current sense signal S1 to produce a signal S2, a current source 26 is coupled to a cathode of the LED 28 by a feedback pin FB of the controller 11 for sinking a constant current ICS, an operational amplifier 16 detects the voltage on the feedback pin FB to produce a signal S3, and a comparator 14 compares the signals S2 and S3 to determine its output provided for the logical circuit 20 to produce the control signals S4 and S5. The LED driver 10 is advantageous in having high efficiency when the input voltage VIN is lower than the forward voltage VF, and is disadvantageous in that the controller 11 requires larger die area because the boost topology needs a larger PMOS transistor 24 to act as a power switch for sourcing a high LED current ID. If it is to operate in larger LED current ID, it needs larger PMOS 24 and thereby more die area.

Therefore, it is desired a high efficiency LED driver which can be implemented with a small die area.

SUMMARY OF THE INVENTION

An object of the present invention is to provide a high efficiency LED driver.

Another object of the present invention is to provide a LED driver which can be implemented with a small die area.

Yet another object of the present invention is to provide a controller of a LED driver.

According to the present invention, a LED driver comprises a controller and an inductor coupled between a power input and an output pin of the controller. The controller includes a power switch coupled between the output pin and a ground node thereof, and switches the power switch to supply an output current by the output pin for LED lighting. The inductor, the power switch and a LED to be lighted by the LED driver are configured to be an asynchronous boost converter, and thereby the LED driver has excellent efficiency. Since a driven LED serves as a rectifier diode in the asynchronous boost converter, the controller has fewer components and thus requires smaller die area.

According to the present invention, a controller of a LED driver having an inductor comprises an output pin for coupling to the inductor and a LED to be lighted, and a power switch coupled to the output pin, such that the power switch, the inductor and the driven LED are configured to be an asynchronous boost converter. The power switch is switched to modulate an output current supplied for the driven LED. Since the driven LED serves as a rectifier diode in the asynchronous boost converter, the controller has fewer components and thus requires smaller die area.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAIL DESCRIPTION OF THE INVENTION

Figure 1:
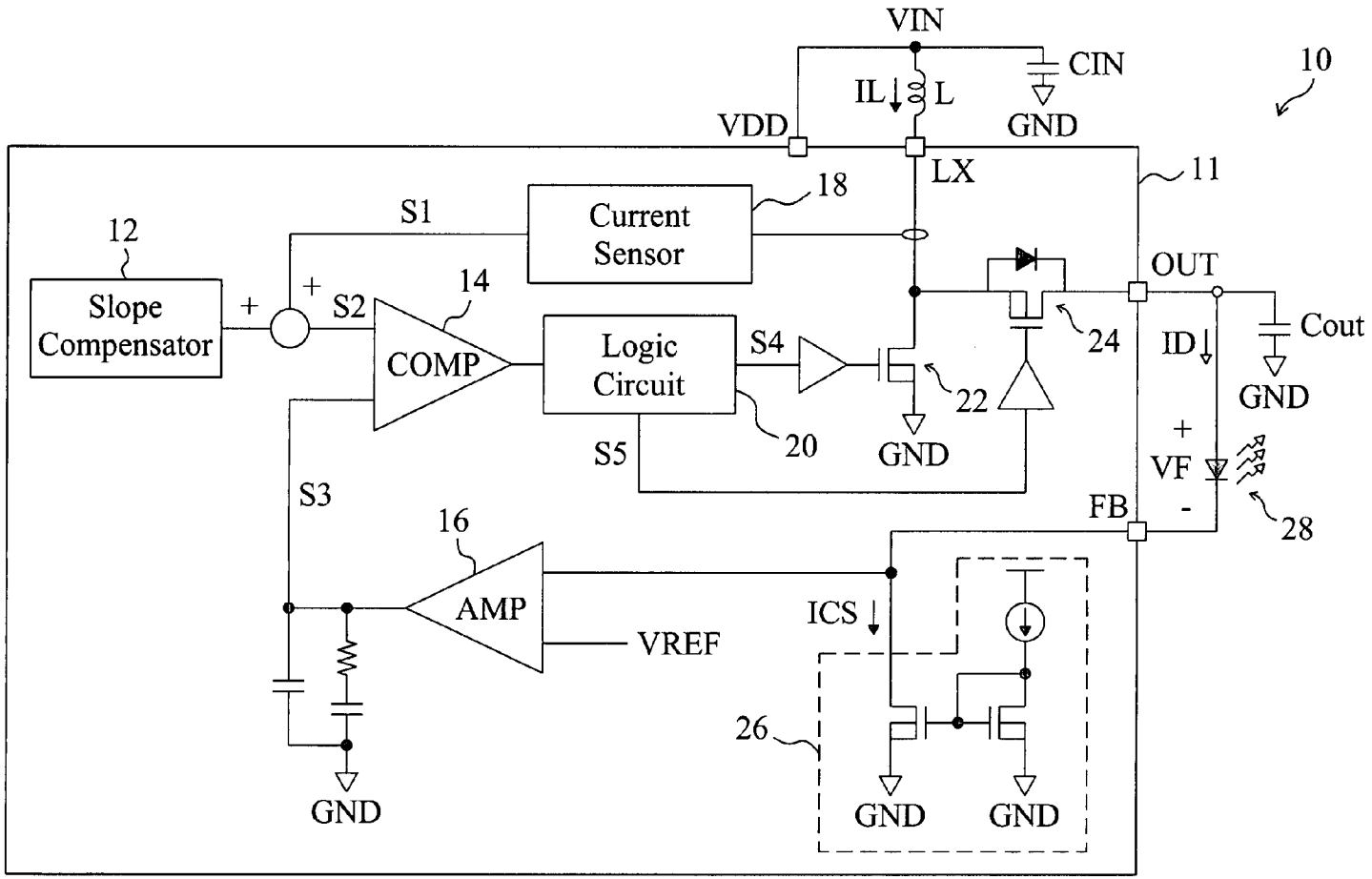
Fig. 1 Prior Art
FIG. 1 shows a boost converter for LED Lighting.
Figure 2:
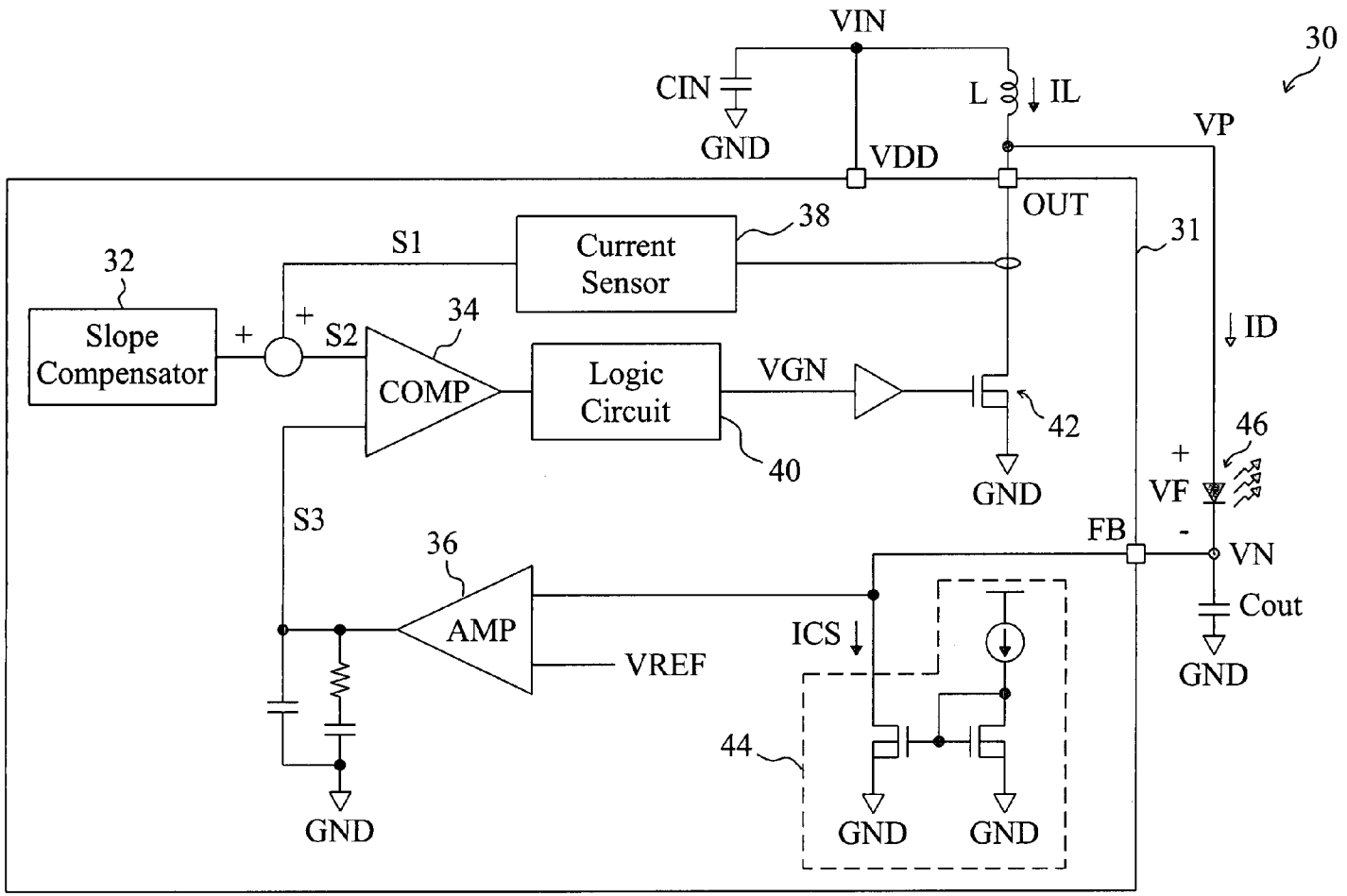
FIG. 2 is an embodiment according to the present invention.

Referring to FIG. 2, a LED driver 30 according to the present invention comprises a controller 31, an inductor L and a capacitor Cout. The inductor L is coupled between a power input receiving an input voltage VIN and an output pin OUT of the controller 31, and the capacitor Cout is coupled between a feedback pin FB of the controller 31 and a ground node GND. The output pin OUT of the controller 31 is also the output terminal of the LED driver 30, and a LED 46 to be lighted has an anode coupled to the output pin OUT and a cathode coupled to the feedback pin FB. In the controller 31, an NMOS transistor 42 serving as a power switch is coupled between the output pin OUT and a ground node GND, a logic circuit 40 provides a control signal VGN to switch the NMOS transistor 42 to produce an output current ID supplied for the LED 46 by the output pin OUT to light up the LED 46, a current sensor 38 monitors the inductor current IL to produce a current sense signal S1, a slope compensator 32 compensates the current sense signal S1 to produce a signal S2, and a current source 44 sinks a current ICS from the feedback pin FB. The LED current ID charges the capacitor Cout and thereby produces a voltage VN on the feedback pin FB, and the current ICS is equal to the average of the LED current ID in steady state. The current source 44 may control the average of the LED current ID. The controller 31 has an operational amplifier 36 to detect the voltage VN on the feedback pin FB to produce a signal S3, and a comparator 34 to compare the signals S2 and S3 to determine its output supplied to the logic circuit 40 to produce the control signal VGN. As shown in this embodiment, the inductor L and the NMOS transistor 42 of the LED driver 30 and the driven LED 46 are configured to be an asynchronous boost converter. Therefore, even when the input voltage VIN is lower than the forward voltage VF of the LED 46, the LED driver 30 still has high efficiency. In addition, compared with the conventional LED driver 10 of FIG. 1, the controller 31 in the LED driver 30 can save the PMOS transistor 24 and thus requires smaller die area.

Figure 3:
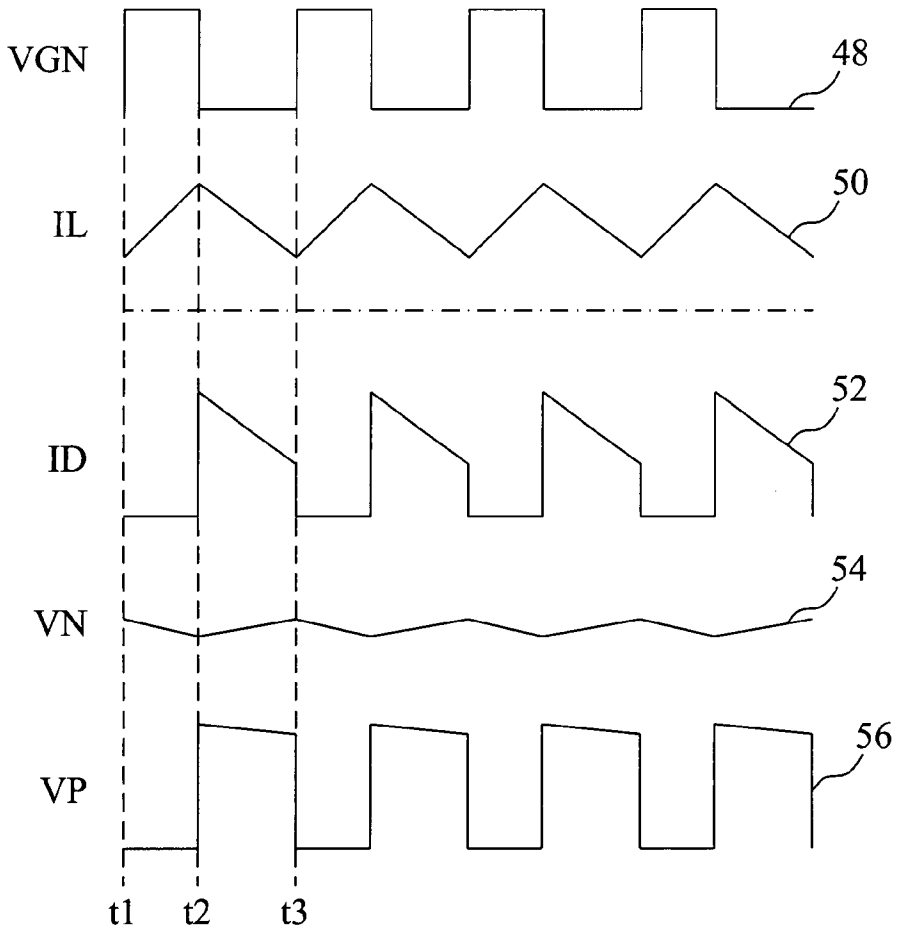
FIG. 3 is a waveform diagram showing several corresponding signals in the circuit of FIG. 2.

FIG. 3 is a waveform diagram showing several corresponding signals in the circuit of FIG. 2, in which waveform 48 represents the control signal VGN, waveform 50 represents the inductor current IL, waveform 52 represents the LED current ID, waveform 54 represents the voltage VN on the feedback pin FB, and waveform 56 represents the voltage VP on the output pin OUT. Referring to FIGS. 2 and 3, when the control signal VGN is high, as shown between time t1 and t2, the NMOS transistor 42 is turned on, so that the voltage VP on the output pin OUT is pulled down to ground potential GND and the LED current ID is zero, as shown by the waveforms 56 and 52 respectively. During this period, the inductor L is charged and stores energy, and the inductor current IL increases with a slope proportional to VIN/L, as shown by the waveform 50. Meanwhile, the voltage VN on the feedback pin FB decreases with a slope proportional to ICS/Cout, as shown by the waveform 54, since the current source 44 sinks the direct current ICS from the capacitor Cout. When the control signal VGN is low, as shown between time t2 and t3, the NMOS transistor 42 is turned off, and the inductor current IL flows to the LED 46. During this period, the voltage VP on the output pin OUT is pulled up to be higher than the voltage VN by the forward voltage VF of the LED 46. Because there is a negative voltage VIN−VP across the inductor L, the inductor current IL decreases with a slope proportional to (VIN−VP)/L. Furthermore, as the LED current ID charges the capacitor Cout, the voltage VN increases with a slope proportional to (ID−ICS)/Cout.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A LED driver for providing an output current to light up a LED, the LED driver comprising:

an inductor coupled between a power input and an output terminal of the LED driver;

a power switch coupled between the output terminal and a ground node, to be switched to modulate the output current;

a capacitor coupled to a cathode of the LED; and a current source sinking a direct current from the capacitor and the direct current being equal to an average of the output current;

wherein the inductor, the power switch and the LED are configured to be an asynchronous boost converter.

2. A controller of a LED driver for modulating a LED current supplied for a LED, the LED driver having an inductor, the controller comprising:

an output pin to be coupled to the inductor and the LED; and a power switch coupled to the output pin to be switched to modulate the LED current;

a feedback pin to be coupled to a cathode of the LED and a capacitor; and a current source coupled to the feedback pin to control an average of the LED current;

wherein the power switch, the inductor and the LED are configured to be an asynchronous boost converter.

* * * * *